United States Patent [19]

Sawin

[11] 4,140,098

[45] Feb. 20, 1979

[54] INDEXABLE HEAD DIAMOND DRESSING TOOL

[75] Inventor: Robert W. Sawin, Newtonville, Mass.

[73] Assignee: The O.K. Tool Company, Inc., Milford, N.H.

[21] Appl. No.: 802,518

[22] Filed: Jun. 1, 1977

[51] Int. Cl.[2] ..... B24B 53/12

[52] U.S. Cl. ..... 125/39; 125/11 N

[58] Field of Search ..... 125/11 R, 11 N, 39

[56] References Cited

U.S. PATENT DOCUMENTS

| | | | |
|---|---|---|---|
| 3,339,538 | 9/1967 | Hohler | 125/11 R |
| 3,452,735 | 7/1969 | Bullock | 125/39 |
| 3,538,903 | 11/1970 | Small | 125/39 |
| 3,709,207 | 1/1973 | Kohlstrunk | 125/11 N |

*Primary Examiner*—Harold D. Whitehead

*Attorney, Agent, or Firm*—Grover and Meegan

[57] ABSTRACT

A diamond dressing tool including a tool holding head member and supporting shank having cooperating conical bearing surfaces urged together in tight frictional engagement by spring means operatively mounted therebetween. The head member is so mounted on the shank to permit its longitudinal movement along the shank bearing surface.

3 Claims, 2 Drawing Figures

INDEXABLE HEAD DIAMOND DRESSING TOOL

BACKGROUND OF THE INVENTION

This invention relates to indexable head diamond dressers and more particularly to an improved means for maintaining the concentricity of the mounted diamond with the axis of the shank portion of the cutting tool. Indexable head diamond dressing tools are known in the prior art and are designed to equalize wear on the diamond cutting element. See for example U.S. Pat. Nos. 2,587,132; 2,761,441; 2,999,493; and 3,452,735. Diamond cutting tools of this type have a tool holding member rotatably cooperating with a supporting shaft. Resilient means urge the two members into tight frictional engagement. The tool holding member may be rotated upon the application of a torque sufficient to overcome the forces holding the tool holding member in its rotative position on the shaft. The use of a rotatable tool holding member eliminates the need for removing the shaft portion from its mounting when a fresh cutting surface portion of the mounted diamond must be positioned for use.

The prior art devices have not, however, eliminated the problem of lateral shifting of the tool holding member with respect to the shaft axis. Previous designs rely on the accuracy and closeness of the fit between the rotating members. After a period of use, however, the confronting surfaces will wear to a degree which will permit the tool holding member to shift radially with respect to the supporting shaft axis with the result that the concentricity of the diamond point with the shaft axis is no longer true. This is a particularly serious problem when, for example, tracer devices which allow no deviation from predetermined datum dimensions are used. In such a device a diamond ground to a specific conical point is mounted concentric with the supporting shaft axis and is required to maintain its original datum point throughout repeated operations. Accurate concentricity of this magnitude cannot be maintained merely by urging rotating member confrontation surfaces such as those disclosed in the prior art together with resilient means. Wear will still result in loss of the diamond point's concentricity with the shaft axis.

SUMMARY OF THE INVENTION

Concentricity of the diamond point with the shaft axis can be maintained over a prolonged period of use only by implementing a dynamic system in which the friction surfaces are permitted to move in wedging engagement upon wear, the movement being initiated by an optimally efficient application of friction surface engaging force, that is, force brought to bear directly on a relatively concentrated surface area. Such a dynamic system, as disclosed herein eliminates the problems associated with indexable head diamond cutting tools of the prior art.

In construction, the diamond dressing tool of the present invention includes a supporting shank which has a conical bearing surface having a predetermined angle with the axis of the shank. The invention further includes a diamond cutting tool having a diamond with a cutting point mounted concentrically at the forward end thereof. A head member mounted on the supporting shank has at one end a second conical bearing surface cooperating with the shank bearing surface. At the opposite end is a recess for securely holding the diamond cutting tool which has side and bottom wall surfaces configured to be received therein. Spring means are operatively disposed between the supporting shank and the head member for exerting engagement force in a direction parallel to the shank and directly against the conical bearing surfaces holding them in tight frictional engagement. The head member is mounted on the shank so that upon wear on the bearing surfaces, the spring means will initiate longitudinal movement of the head bearing surface along the shank bearing surface. This compensates for the wear, thereby preventing lateral movement of the head member with respect to the shank axis and maintaining the concentricity of the diamond therewith. In addition, as the conical bearing engagement surface area is small, the engagement force is concentrated over a limited area thereby insuring optimal use of the resilient force generated by the spring means.

Further, in accordance with the indexable head diamond dresser disclosed herein, the placement of the spring means proximal the conical bearing surfaces also allows the length of the supporting shaft to be varied without effecting the rotational characteristics of the head member. The disclosed device is sturdy, simple to use and maintain, and may be manufactured in a manner to permit the torque required to rotate the head member to be preset at the factory.

DETAILED DESCRIPTION OF THE PREFERRED EMBODIMENT

Figure 1:
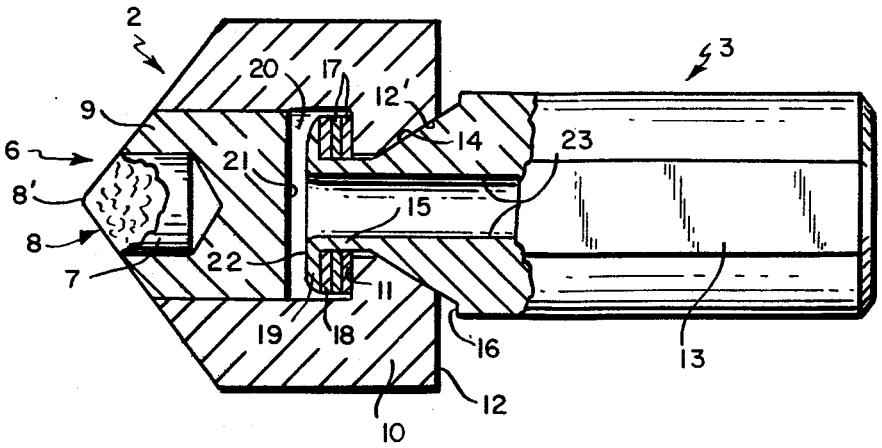
FIG. 1 is a side view partially in cross section of the assembled diamond dressing tool.

The diamond dressing tool 1 as shown in FIG. 1 includes a head member 2 and a shank 3. The head member has an outer configuration consisting of multiple facets. This faceted configuration facilitates the rotation of the head with a tool member, not shown, having a complementary gripping surface. The head, at one end, has a front recess 4 defined by recess walls 5 for holding a diamond cutting tool 6. The diamond cutting tool 6 consists of a slug 7 partially encasing a diamond 8 having a cutting point 8' and a diamond slug carrier 9. When the diamond cutting tool 6 is positioned in the recess 4 the diamond point 8' is concentric with the head central axis. The cutting tool 6 is secured in the recess 4 by force fitting in conjunction with a strong adhesive. The opposite rear end of the head member 2 is provided with an annular flange 10, having a front wall 11 and a rear wall 12 which forms a conical bearing surface 12' having an angle with the head central axis of 30° ± 15'. The flange forms a passage connecting the rear end of the head member to the bottom of the front recess 4.

The shank 3 has an elongated rearmost portion having a flat surface 13. The elongated portion is configured for non-rotatable mounting in a holder, not shown, with the flat surface 13 providing a contact point for a set screw. The shank has a conical medial portion forming a conical bearing surface 14. The conical bearing surfaces 12' and 14 also serve as friction confrontation surfaces. The shank conical friction confrontation surface 14 has an angle with the central shank axis of approximately 30° ± 15' and is configured to frictionally engage the head member conical friction confrontation surface 12'.

The shank 3 is further provided with a tubular front extension defining a male fitting 15 which is concentric with the shank axis and comprised of material distortable under predetermined force. A shank shoulder 16 defines the rearmost extent of the shank bearing surface 14.

Figure 2:
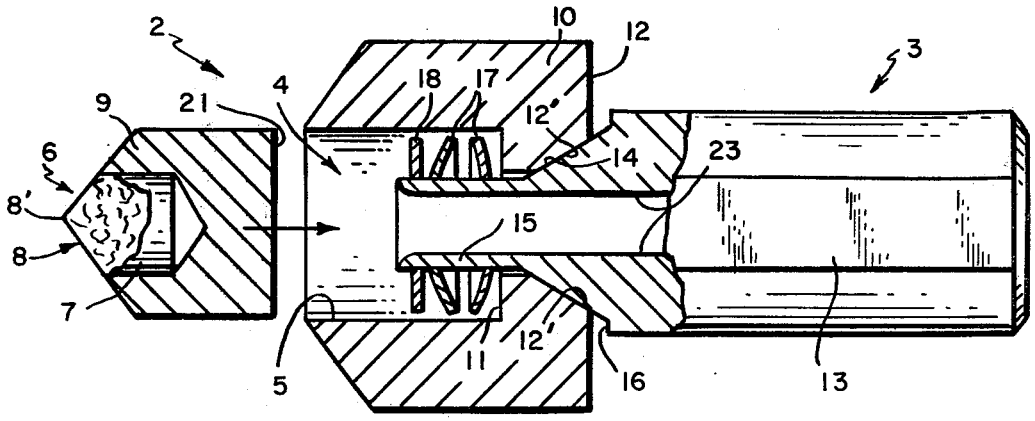
FIG. 2 is a side view partially in cross section of the partially assembled diamond dressing tool.

To assemble the indexable head diamond dresser, the tubular front extension 15 of the supporting shank 3 is inserted through the head member annular flange 10 until the respective conical bearing surfaces 12' and 14 are in engagement, as shown in FIG. 2. In this position the head central axis is coincident with the central shank axis. Spring means, which in the preferred embodiment consists of two Belleville washers 17, and a flat washer 18, are next positioned around the tubular extension 15. The front end of the tubular extension is then subjected to a predetermined rearwardly directed force from a device such as a 120° punch inserted through the empty diamond cutting tool recess 4. This procedure forms the shank spring retaining means 19 which compresses the Belleville washers against the front wall 11 of the head member annular flange 10. The spring means has a predetermined resilient force directed parallel to the shank axis sufficient to urge the conical bearing surfaces 12' and 14 into tight frictional engagement thus preventing rotation of the head member 2 about the shank 3 absent the application of a predetermined torque.

As shown in FIG. 1 when the diamond cutting tool 6 is fitted into the head member recess 4 a space 20 of predetermined size is defined by the rear surface 21 of the tool carrier 9, the side wall surfaces 5 of the tool carrier recess and the front surface 22 of the shank spring retaining means 19.

Prior to the need for replacement, wear on the diamond point 8' is compensated for by rotating the head member by the application of predetermined torque, thus providing a new diamond cutting surface at the point of operational contact. Any wear on the conical bearing surfaces 12' and 14 which would result in lateral movement of the head member is compensated for by the longitudinal movement of the head member bearing surface 12' along the shank member bearing surface 14. This longitudinal movement is permitted by the above defined space 20 and is initiated by the constant pressure exerted by the spring means 17. The concentricity of the diamond point 8' with the shank axis is maintained despite repeated rotative adjustment of the head member about the shank by this dynamic cooperation of the spring means 17 with the conical bearing surfaces 12' and 14.

The above mentioned deforming force applied to the front end of the shank extension in forming the spring retention means 19 also presets the torque required to overcome the spring force holding the head member 2 in its rotative cutting position on the shank 3. When the cutting tool 6 is positioned within its recess 4, access to the shank spring retention means as well as the spring means is prevented absent total removal of the cutting tool from its recess. This assembly insures that the operating characteristics which the dynamic system is designed to preserve will be controlled by the manufacturer. As already stated, the spring means 17 direct engaging force parallel to the shank axis onto the bearing surfaces 12' and 14. Due to the positioning of the spring means proximal the bearing surfaces the distance that the engaging force must travel is kept to a minimum thus insuring that maximum force will be brought to bear on the surfaces 12' and 14.

As shown in FIGS. 1 and 2, the shank is provided with an axial bore 23 extending its entire length. A tool may be inserted through the bore 23 and placed in contact with the rear surface 21 of the tool carrier 9 thus providing easy removal thereof when a replacement tool carrier must be inserted into the head member recess 4.

I claim:

1. A diamond dressing tool comprising:

(a) a supporting shank having a first conical bearing surface, said bearing surface having a predetermined angle with the longitudinal axis of said shank;

(b) a diamond cutting tool having a diamond with a cutting point;

(c) a head member mounted on the supporting shank having, (1) a recess at the one end thereof for securely holding the diamond cutting tool therein with the cutting point of the diamond located on the longitudinal axis of the shank, and (2) a second conical bearing surface at the other end engaging with said shank bearing surface;

(d) spring means operatively disposed between the supporting shank and the head member for exerting a force in a direction parallel to the longitudinal axis of the shank and against said conical bearing surfaces thereby holding them in tight frictional engagement, (e) an inwardly directed annular flange at the other end of the head member forming a passage extending into the head member from the other end, said flange including:

(1) a rear conical wall surface defining the second conical bearing surface, and (2) a front wall surface facing the diamond cutting tool recess and surrounding said passage, (f) a male fitting on said shank extending forwardly of said conical bearing surface, said fitting extending through said passage from the other end of the head member; and (g) a radially outwardly extending spring retention means at the front end of said fitting, said retention means being positioned in spaced facing relationship to the front wall of said annular flange for compressively holding said spring means therebetween to urge said conical surfaces togehter in tight frictional engagement, wherein:

(h) the passage is in communication with the diamond tool recess; and (i) the male fitting extends into the recess thereby exposing the front end of the male fitting to the application of the deforming force prior to the placement of the diamond cutting tool in the recess, and wherein:

(j) the diamond cutting tool in the recess is axially spaced from the spring retention means.

2. The diamond dressing tool according to claim 1 wherein:

(a) an axial bore extends through the shank and into communication with said recess whereby pressure may be applied to the diamond cutting tool for removal thereof from the recess.

3. A diamond dressing tool comprising:

(a) a shank having:
(1) an elongated rear portion configured to be detachably secured in a holder,
(2) a substantially conical medial portion concentric with the longitudinal axis of said shank forming a first conical friction confrontation surface, and
(3) a generally tubular extension forward of the medial portion with a substantially radially outwardly extending spring retention means at the end thereof;
(b) a diamond cutting tool having a diamond with a cutting point;
(c) a head member mounted on the shank and having:
(1) a recess at one end for securely holding the diamond cutting tool, and
(2) an inwardly directed annular flange at the other end having:
(i) a front wall facing the recess,
(ii) a rear wall forming a second conical friction confrontation surface, cooperating in frictional engagement with said first conical friction confrontation surface, and
(iii) a passage formed by the annular flange extending into the head member with the head member being so mounted on the shank that the tubular extension is positioned within said passage and the spring retention means is in spaced facing relationship to the front wall of the annular flange; and
(d) spring means positioned around the tubular extension and between the spring retention means and the front wall of the flange for urging them apart and holding said first and second friction confrontation surfaces in tight engagement.

* * * * *